US006779431B2

(12) United States Patent
Hönlinger

(10) Patent No.: US 6,779,431 B2
(45) Date of Patent: Aug. 24, 2004

(54) ARRANGEMENT FOR PROTECTING THE CREW OF A MILITARY VEHICLE FROM MINE EXPLOSION CONSEQUENCES

(75) Inventor: Michael Hönlinger, München (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 10 days.

(21) Appl. No.: 10/116,517

(22) Filed: Apr. 4, 2002

(65) Prior Publication Data

US 2002/0145308 A1 Oct. 10, 2002

(30) Foreign Application Priority Data

Apr. 7, 2001 (DE) ..... 101 17 575

(51) Int. Cl.[7] ..... F41H 7/02
(52) U.S. Cl. ..... 89/36.08; 296/193.07
(58) Field of Search ..... 89/36.08; 296/193.07, 296/204

(56) References Cited

U.S. PATENT DOCUMENTS

| | | | | | |
|---|---|---|---|---|---|
| 2,348,130 | A | * | 5/1944 | Hardy | 109/84 |
| 5,533,781 | A | * | 7/1996 | Williams | 296/204 |
| 5,663,520 | A | | 9/1997 | Ladika et al. | |
| 6,477,934 | B1 | * | 11/2002 | Bruhn et al. | 89/36.08 |
| 2003/0010189 | A1 | * | 1/2003 | Zonak | 89/36.08 |

FOREIGN PATENT DOCUMENTS

| | | | | | |
|---|---|---|---|---|---|
| DE | 2151015 | | | 4/1973 | |
| DE | 2 325921 | | | 12/1974 | |
| DE | 3410962 | A1 | * | 9/1985 | F41H/07/04 |
| DE | 3627485 | A1 | * | 2/1988 | F41H/7/04 |
| DE | 42 34 369 | | | 4/1994 | |
| DE | 431 60 95 | | | 11/1994 | |
| DE | 19605230 | A1 | * | 8/1997 | F41H/5/04 |
| DE | 19631715 | A1 | * | 2/1998 | F41H/7/04 |
| DE | 849560 | A2 | * | 6/1998 | F41H/7/02 |
| DE | 197 35 594 | | | 2/1999 | |
| DE | 199 41 928 | | | 3/2001 | |
| FR | 2706997 | A | * | 12/1994 | F41H/5/007 |
| GB | 2099963 | A | * | 12/1982 | F41H/5/02 |

* cited by examiner

*Primary Examiner*—Michael J. Carone
*Assistant Examiner*—Troy Chambers
(74) *Attorney, Agent, or Firm*—R W Becker & Associates; R W Becker

(57) ABSTRACT

An arrangement is provided to protect the occupants of a military vehicle in the event of a percussive-type impact on a surface of the vehicle, such as a mine explosion below the vehicle. The arrangement includes a foot floor supported at a spacing from a respective portion of the interior surface of the cabin which is intermediate the foot floor and the travel surface on which the vehicle is traveling. No structures connect the foot floor and the interior surface of the cabin to one another with a rigidity sufficient to transmit to the foot floor more than a negligible amount of the energy of a deflection of the interior of the cabin in the event that a percussive-type event such as amine explosion causes the interior cabin surface to deflect.

8 Claims, 1 Drawing Sheet

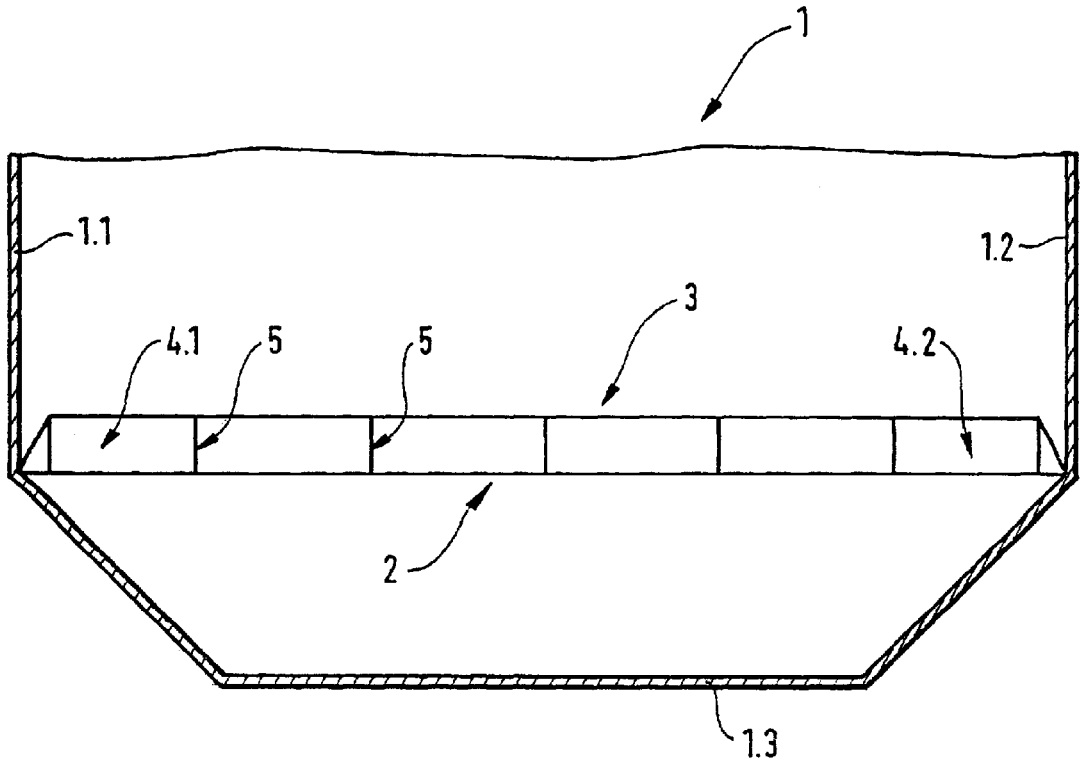
1
1.1
1.2
3
4.1
5
5
4.2
2
1.3

ARRANGEMENT FOR PROTECTING THE CREW OF A MILITARY VEHICLE FROM MINE EXPLOSION CONSEQUENCES

BACKGROUND OF THE INVENTION

The present invention relates to an arrangement for protecting the crew of a military vehicle from the consequences of a mine explosion.

In connection with vehicles used in connection with military battle operations, the problem arises that, upon the driving over of a mine and the ensuing explosion, an extreme impact loading on the underside of the vehicle occurs which is transmitted to the vehicle inner floor and, thereby, to the vehicle occupants, who either stand on the vehicle inner floor or sit on the vehicle seats with their feet on the vehicle inner floor or on foot rests connected to the vehicle inner floor and, thus, such explosion events are very dangerous. It is already known to de-couple the vehicle seats in such a military vehicle from the vehicle inner floor and the side walls; however, the danger always still exists of foot injuries as a result of the inward bowing or deflection of the vehicle surfaces due to a mine explosion or other percussive-type event, as well as injuries resulting from the vehicle pieces, splinters, and the like which fly around due to the inward bowing or deflection.

SUMMARY OF THE INVENTION

The present invention offers a solution to the challenge of providing an arrangement for the protection of the crew of a military vehicle in the event of a mine explosion which, in spite of the resulting inward bowing or deflection, protects the vehicle inhabitants from a foot injury or an injury due to material flying around.

The solution to the challenge is, in accordance with the present invention, implemented in that, above the vehicle inner floor, a foot floor is arranged which, at least in one operating position, is characterized by a position at a pre-determined spacing from the vehicle inner floor, whereby, between the foot floor and the vehicle inner floor, an air space exists and no rigid, pressure-transmitting connecting elements are located between the foot floor, on the one hand, and the vehicle inner floor in the side walls of the vehicle, on the other hand.

The basic concept of the invention resides in the fact that, within the vehicle, a foot floor is arranged over the actual vehicle inner floor, the foot floor being fully de-coupled from the vehicle inner floor. This is achieved in that, on the one hand, the foot floor is, in its protection-providing, operating position, at a pre-determined distance from the vehicle inner floor which forecloses the risk that the foot floor is directly impacted by the inward bowing or deflection of the vehicle inner floor and in that, on the other hand, between this foot floor and the vehicle bottom, as well as the side walls of the vehicle, no rigid, pressure-transmitting connecting elements are provided. In a particularly advantageous embodiment of the arrangement of the present invention, the foot floor is supported by one or more air spring bags on the vehicle inner floor. The number of air spring bags can be selected in correspondence with the stiffness of the foot floor. If the foot floor is soft and flexible, then the support of the foot floor over the entirety of the bottom surface can be effected by means of one or more air spring bags. If the foot floor is, in contrast, rigid and self-supporting, then only a few air spring bags, such as, for example, only bags deployed in the edge region, are required. The rigidity of the foot floor is determined substantially by the weight and whether other additional protective functions such as, for example, a splinter protection function, are to be undertaken.

It is also particularly advantageous if the foot floor can be raised directly from a rest position above the vehicle inner floor into its protection providing operating position. This is particularly effectively implementable by means of an inflatable air spring bag. During the operation of the vehicle, the vehicle crew can use the raised foot floor. During entrance or exit from the vehicle, the foot floor can be lowered by a reduction of the air pressure, in order to thereupon make use of the full interior space height of the vehicle.

In its raised condition, the foot floor operates as a foot support de-coupled from the vehicle inner floor and permits, in comparison to conventional foot supports, a comfortable foot support function. The distance between the raised foot floor and the vehicle inner floor permits a free dynamic resilient spring action by the vehicle inner floor in the event of mine detonation and prevents the further transmission of an explosion impulse to the feet of the vehicle inhabitants.

An embodiment of the arrangement of the present invention is described hereinafter in connection with the drawings.

BRIEF DESCRIPTION OF THE DRAWINGS

The sole FIGURE of the drawing is a schematic sectional view of a military vehicle having the inventive arrangement for protecting the crew of a military vehicle from the consequences of a mine explosion.

DETAILED DESCRIPTION OF THE PREFERRED EMBODIMENT

In the sole FIGURE of the drawing, a rudimentary schematic view of the under-portion of the housing or interior cabin of an otherwise not-illustrated military vehicle is shown. This housing under-portion 1 compromises side walls 1.1 and 1.2, as well as a floor wall or pan 1.3 which is closed off on its top side by a vehicle inner floor 2. Vehicle seats and other vehicle components are arranged in a non-illustrated manner in the vehicle interior, such vehicle seats and components being suspended, for example, from the housing deck or cover. A foot floor 3 is arranged above the vehicle inner floor 2. In the illustrated embodiment, the foot floor 3 is composed of a rigid self-supporting material and is supported by air spring or pneumatic bags—namely, air spring bags 4.1 and 4.2—solely at its edge regions. Furthermore, flexible connecting elements 5 are located between the foot floor and the vehicle inner floor, the connecting elements being in the form of straps or bands. The foot floor 3 is supported vertically by the air pressure in the air spring bags 4.1 and 4.2 and is held in an equilibrium or balanced condition by the flexible straps or bands 5. No rigid connections exist between the foot floor and the side walls 1.1 and 1.2 or the vehicle inner floor 2. The straps or bands 5 can only exert a tension force and cannot exert a compression force, whereby these straps or bands prevent the further transmission of the impulse wave, which results from the mine blast, from the vehicle inner floor 2 onto the foot floor 3. During entrance and exit of the vehicle, the foot floor 3 is lowered by a reduction of the air pressure in the air spring bags 4.1 and 4.2 into a rest position.

The specification incorporates by reference the disclosure of German priority document 101 17 575.2 of Apr. 7, 2001.

The present invention is, of course, in no way restricted to the specific disclosure of the specification and drawings, but also encompasses any modifications within the scope of the appended claims.

What I claim is:

1. An arrangement to protect the occupants of a military vehicle in the event of a percussive-type impact on a surface of the vehicle, the vehicle including a cabin having an interior surface and the interior surface of the cabin being subject to deflection in the event of a percussive-type event, the arrangement comprising:

a foot floor being selectively alternatively disposable between at least one position which is an operating position at which the foot floor is supported at a damage mitigation spacing, from a respective portion of the interior surface of the cabin which is intermediate the foot floor and the travel surface on which the vehicle is traveling and at which no structures connect the foot floor and the interior surface of the cabin to one another with a rigidity sufficient to transmit to the foot floor more than a negligible amount of the energy of a deflection of the interior surface of the cabin in the event of a percussive-type event, and a rest position at which the foot floor is closer to the respective portion of the interior surface of the cabin than in its operating position, the foot floor being selectively movable, at a time prior to the occurrence of a percussive-type event, between its operating position and its rest position in a sequence of movement such that the foot floor moves successively from its operating position into its rest position and then returns to its operating position, whereupon the foot floor is available, upon ultimately returning to its operating position at the end of such sequence of movement, for supporting the feet of a vehicle occupant.

2. An arrangement according to claim 1, and further comprising at least one support member having a compressible fluid therein, the support member being disposed between and in contact with the foot floor and the respective portion of the interior surface of the cabin, the volume of the compressible fluid in the support member being a selected one of a volume that is variable to thereby vary the spacing of the foot floor and the respective portion of the interior surface of the cabin from one another and a volume that is invariable.

3. An arrangement according to claim 1, wherein the foot floor comprises a flexible material and further comprising at least one support member for supporting the foot floor on the respective portion of the interior surface of the cabin, the support member having a compressible fluid therein and being disposed between the foot floor and the respective portion of the interior surface of the cabin and in contact with substantially the entirety of the foot floor.

4. An arrangement according to claim 1, wherein the foot floor comprises a relatively stiff, self-supporting material and further comprising at least one support member for supporting the foot floor on the respective portion of the interior surface of the cabin, the support member having a compressible fluid therein and being disposed between the foot floor and the respective portion of the interior surface of the cabin and in contact with only less than the entirety of the foot floor.

5. An arrangement according to claim 2, and further comprising substantially non-rigid connecting elements, extending between and connected to the foot floor and the interior surface of the cabin.

6. An arrangement according to claim 5, wherein the substantially non-rigid connecting elements extending between and connected to the foot floor and the interior surface of the cabin are straps.

7. An arrangement according to claim 5, wherein the substantially non-rigid connecting elements extending between and connected to the foot floor and the interior surface of the cabin are bands.

8. An arrangement according to claim 1, wherein the vehicle includes a floor pan and the respective portion of the interior surface of the vehicle is a vehicle inner floor that is disposed intermediately between the floor pan and the foot floor such that the vehicle inner floor is at a respective fixed spacing from the floor pan and at the damage mitigation spacing from the foot floor, wherein, during movement of the foot floor between its operating position and its rest position, the damage mitigation spacing between the foot floor and the respective portion of the interior surface of the vehicle varies while the fixed spacing between the floor pan and the respective portion of the interior surface of the vehicle does not vary.

* * * * *